US006464509B1

(12) United States Patent
Emberty et al.

(10) Patent No.: US 6,464,509 B1
(45) Date of Patent: Oct. 15, 2002

(54) SYSTEM AND METHOD REQUIRING ZERO INSERTION FORCE AND POSITIVE RETENTION OF REMOVABLE STORAGE MEDIA IN A DATA STORAGE SUBSYSTEM

(75) Inventors: Robert George Emberty, Tucson; Craig Alan Garrett, Vail; Craig Anthony Klein, Tucson, all of AZ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/844,188

(22) Filed: Apr. 26, 2001

(51) Int. Cl.[7] ..... H01R 11/30
(52) U.S. Cl. ..... 439/39; 439/38
(58) Field of Search ..... 439/39, 38, 153, 439/923, 700; 200/52 R

(56) References Cited

U.S. PATENT DOCUMENTS

| | | | | |
|---|---|---|---|---|
| 3,431,428 A | * | 3/1969 | Van Valer | |
| 3,810,258 A | | 5/1974 | Mathauser | |
| 4,317,969 A | * | 3/1982 | Rlegler et al. | 200/52 |
| 4,899,254 A | | 2/1990 | Ferchau et al. | |
| 5,253,246 A | | 10/1993 | Leonhardt et al. | |
| 5,401,175 A | * | 3/1995 | Guimond et al. | 439/38 |
| 5,454,000 A | | 9/1995 | Fasig et al. | |
| 5,954,520 A | * | 9/1999 | Schmidt | 439/39 |
| 5,970,030 A | | 10/1999 | Dimitri et al. | |
| 6,264,473 B1 | * | 7/2001 | Bullinger et al. | 439/38 |

FOREIGN PATENT DOCUMENTS

| | | |
|---|---|---|
| JP | 5135557 | 6/1993 |
| JP | 0589861 | 7/1993 |
| JP | 7220464 | 8/1995 |

* cited by examiner

*Primary Examiner*—P. Austin Bradley
*Assistant Examiner*—Alexander Gilman
(74) *Attorney, Agent, or Firm*—Jean M. Barkley; Bracewell & Patterson, L.L.P.

(57) ABSTRACT

A disk drive library has individual disk drives that are each provided with a combination mechanical and electrical connector for interfacing with a library backplane. Each connector has two components. The first component is mounted to the drive and has an electrical contact with a metallic burnished core of highly conductive material that is surrounded by an annular magnet. The mating component is on the backplane and is similarly formed with the opposite pole of a second magnet. When the two components are brought into close proximity, the two contacts attract each other to mate the contact cores, and thus establish an electrical connection. This connection is augmented by a spring mechanism to provide a solid, reliable connection.

1 Claim, 4 Drawing Sheets

SYSTEM AND METHOD REQUIRING ZERO INSERTION FORCE AND POSITIVE RETENTION OF REMOVABLE STORAGE MEDIA IN A DATA STORAGE SUBSYSTEM

BACKGROUND OF THE INVENTION

1. Technical Field

This invention relates in general to data access and storage devices, and in particular to disk drives. Still more particularly, the present invention relates to a storage library of media that are removable therefrom via automated control with positive retention and zero insertion force.

2. Description of the Related Art

Generally, a data access and storage system consists of one or more storage devices that store data on magnetic or optical storage media. For example, a magnetic storage device is known as a direct access storage device (DASD) or a hard disk drive (HDD) and includes one or more disks and a disk controller to manage local operations concerning the disks. The hard disks themselves are usually made of aluminum alloy or a mixture of glass and ceramic, and are covered with a magnetic coating. Typically, two or three disks are stacked vertically on a common spindle that is turned by a disk drive motor at several thousand revolutions per minute (rpm).

The only other moving part within a typical HDD is the actuator assembly. Within most HDDs, the magnetic read/write head is mounted on a slider. A slider generally serves to mechanically support the head and any electrical connections between the head and the rest of the disk drive system. The slider is aerodynamically shaped to glide over moving air in order to maintain a uniform distance from the surface of the rotating disk, thereby preventing the head from undesirably contacting the disk.

Typically, a slider is formed with an aerodynamic pattern of protrusions (air bearing design) on its air bearing surface (ABS) that enables the slider to fly at a constant height close to the disk during operation of the disk drive. A slider is associated with each side of each platter and flies just over the platter's surface. Each slider is mounted on a suspension to form a head gimbal assembly (HGA). The HGA is then attached to a semi-rigid actuator arm that supports the entire head flying unit. Several semi-rigid arms may be combined to form a single armature unit.

Each read/write head scans the surface of a disk during a "read" or "write" operation. The head and arm assembly is moved utilizing an actuator that is often a voice coil motor (VCM). The stator of a VCM is mounted to a base plate or casting on which the spindle is also mounted. The base casting is in turn mounted to a frame via a compliant suspension. When current is fed to the motor, the VCM develops force or torque that is substantially proportional to the applied current. The arm acceleration is therefore substantially proportional to the magnitude of the current. As the read/write head approaches a desired track, a reverse polarity signal is applied to the actuator, causing the signal to act as a brake, and ideally causing the read/write head to stop directly over the desired track.

The individual storage media in, for example, a redundant array of independent storage devices, are typically each loaded in a carrier, mounted in a drawer in the storage subsystem, and individually connected in parallel to a backplane. Each device has a read/write interface, such as a conventional small computer system interface (SCSI) or Fibre Channel Arbitrated Loop (FC-AL) connector, that allows the host computer to access and store data on the device. Although current hardware designs are acceptable, an improved and more efficient system and method for handling the individual storage devices would be desirable.

SUMMARY OF THE INVENTION

In one embodiment of a library of disk drives of the present invention, the individual drives are each provided with a combination mechanical and electrical connector for interfacing with a library backplane. Each connector interface has two components. The first component is mounted to the disk drive and has an electrical contact with a metallic burnished core of highly conductive material that is surrounded by an annular magnet. The mating component is on the backplane and is similarly formed with the opposite pole of a second magnet. When the two components are brought into close proximity, the two contacts attract each other, mating the contact cores, and thus establish an electrical connection. This connection is augmented by a spring mechanism to provide a solid, reliable connection.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

BEST MODE FOR CARRYING OUT THE INVENTION

Figure 5:
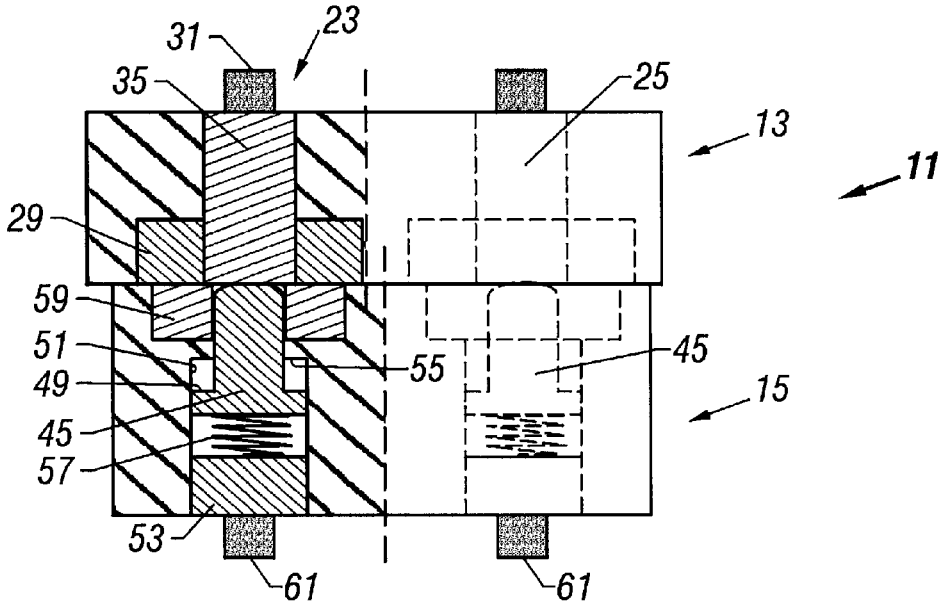
FIG. 5 is a half-sectional side view of the carrier and backplane connectors of FIGS. 2 and 3, respectively, in operation.

Referring to FIG. 5, one embodiment of a connector system 11 having two separable connector components 13, 15 is shown. For purposes of illustration, a computer data access and storage system such as data storage system 17 (FIG. 12) is described. However, the system and method of the present invention also may be readily applied to various other systems and devices as well, such as consumer electronic applications, for example.

Figure 1:
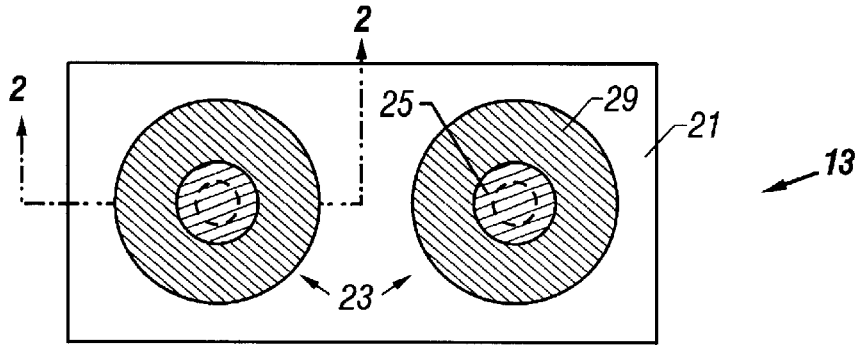
FIG. 1 is a plan view of one embodiment of a carrier connector constructed in accordance with the present invention.
Figure 2:
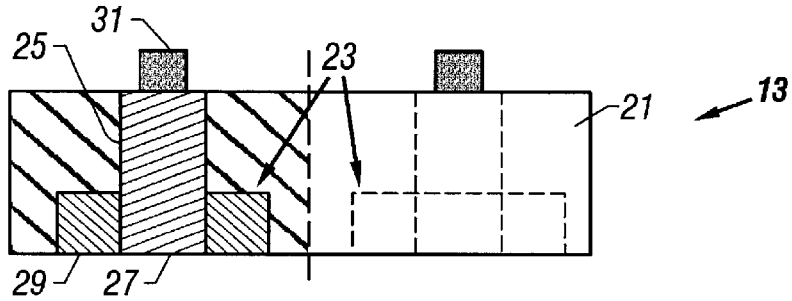
FIG. 2 is a half-sectional side view of the carrier connector of FIG. 1 taken along the line 2—2 of FIG. 1.

As shown in FIGS. 1 and 2, connector system 11 has a carrier connector 13 with a generally rectangular body 21 and at least one interfacing element 23 (two shown) that are mounted therein in a side-by-side configuration. Although carrier connector 13 is shown with two interfacing elements 23, it may be provided with only one, or three or more interfacing elements 23 that may or may not be identical to each other.

Each interfacing element 23 comprises a core 25 of electrically conductive material having a contact surface 27 (FIG. 2) that is located adjacent to a coupling device 29. In the preferred embodiment, core 25 is a generally cylindrical, metallic burnished copper, silver, or other highly conductive material, and coupling device 29 is an annular permanent magnet that circumscribes contact surface 27. In addition, contact surface 27 may be provided with a silver coating. Ideally, the outer face of coupling device 29 is substantially flush with contact surface 27, as shown. Each interfacing element 23 also has an electrical connection 31 such as a solder connection located opposite contact surface 27 for interconnecting with a host device, as will be further explained below.

Figure 3:
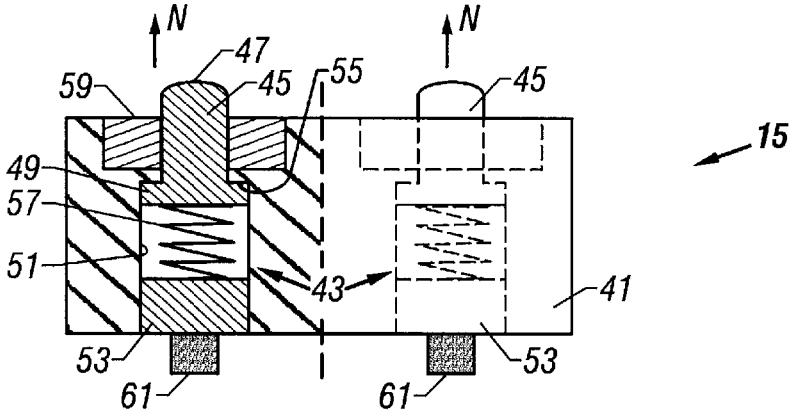
FIG. 3 is a half-sectional side view of one embodiment of a backplane connector constructed in accordance with the present invention and taken along the line 3—3 of FIG. 4.
Figure 4:
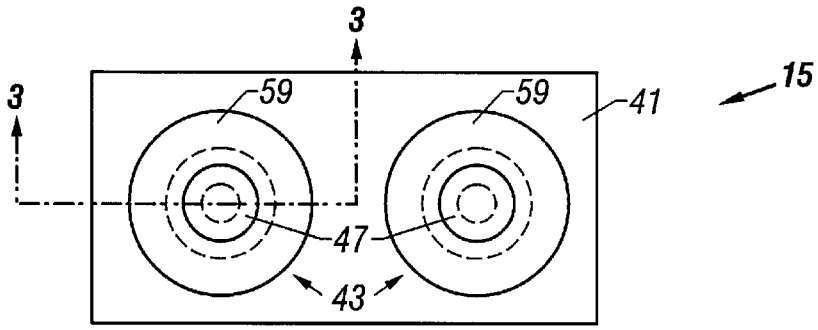
FIG. 4 is a plan view of the backplane connector of FIG. 3.

Referring now to FIGS. 3 and 4, the other or mating component of connector system 11 is backplane connector 15. Each backplane connector 15 has a generally rectangular body 41 and at least one interfacing element 43 (two shown) that are mounted side-by-side in body 41. Ideally, the number of interfacing elements 43 corresponds to and coaxially aligns with the number of interfacing elements 23 in carrier connector 13 in a one-to-one ratio.

Each coupling element 43 comprises an independently movable insert 45 of electrically conductive material having a contact surface 47. In the preferred embodiment, insert 45 is a generally cylindrical, metallic burnished copper, silver, or other highly conductive material with a flange 49 on one end. Contact surface 47 also may be provided with a silver coating and is ideally convex as shown. Each insert 45 is located in a cavity 51 in body 41 that is sealed on one end by a threaded plug 53. The other end of cavity 51 has a reduced diameter with a shoulder 55 for limiting the motion of insert 45 via flange 49. An electrically conductive compression spring 57 is also located in cavity 51 and extends between the flange 49 on insert 45 and the inner surface of plug 53. Spring 57 biases insert 45 to an extended position (FIG. 3) wherein contact surface 47 extends outside of body 41. Insert 45 also may be depressed or pushed down into cavity 51 (FIG. 5) such that contact surface 47 is flush with or located inside cavity 51. Alternatively, the carrier and backplane connectors 13, 15 may be switched such that they are mounted to the other's support structure.

Again referring to FIG. 3, backplane connector 15 also has a coupling device 59, such as an annular permanent magnet, that circumscribes one end of cavity 51 and contact surface 47 as shown. Each interfacing element 43 also has an 25 electrical connection 61 such as a solder connection located opposite contact surface 27 for interconnecting with another device.

In operation (FIG. 12), one version of data storage system 17 comprises a disk drive library having an array of detachable, independent disk drive assemblies 100 having, for example, a carrier or tray for supporting a disk drive. A carrier connector 13 is mounted to a rearward end of each disk drive assembly 100 such that solder connection 31 is interconnected therewith. A movable robotic picking mechanism or picker 300 is used to selectively insert and remove individual ones of the disk drive assemblies 100 relative to a plurality of library drawers or bins 310 and/or other locations 320. Each bin 310 is provided with a backplane connector 15 that is interconnected with a backplane 290 via solder connection 61. Backplane 290 is provided for interfacing with a host computer or processor 46 associated with the data storage system or disk drive library.

As disk drive assembly 100 is inserted into a bin 310, connectors 13, 15 interconnect as shown in FIG. 5 to provide electrical power and/or operational control and/or data signals between host computer 46, backplane 290, and disk drive assemblies 100. In the embodiment shown, both of these functions are possible because of the plurality of interfacing elements 23, 43, each of which is capable of providing a different function. Other configurations also may be provided wherein both functions are achieved through a single matched pair of interfacing elements 23, 43.

When a drive assembly 100 is mated with the backplane 290, the opposite-poled magnets 29, 59 attract each other in such a manner as to coaxially align their respective cores 25 and inserts 45. Magnets 29, 59 pull cores 25 and inserts 45 into contact with each other and thereby push inserts 45 down into cavities 51 until magnets 29, 59 abut one another as shown in FIG. 5. Since the contact area between cores 25 and inserts 45 has significant overlap, their respective surfaces 27, 47 make contact even when slightly off-axis so that electrical connectivity is assured.

Figure 12:
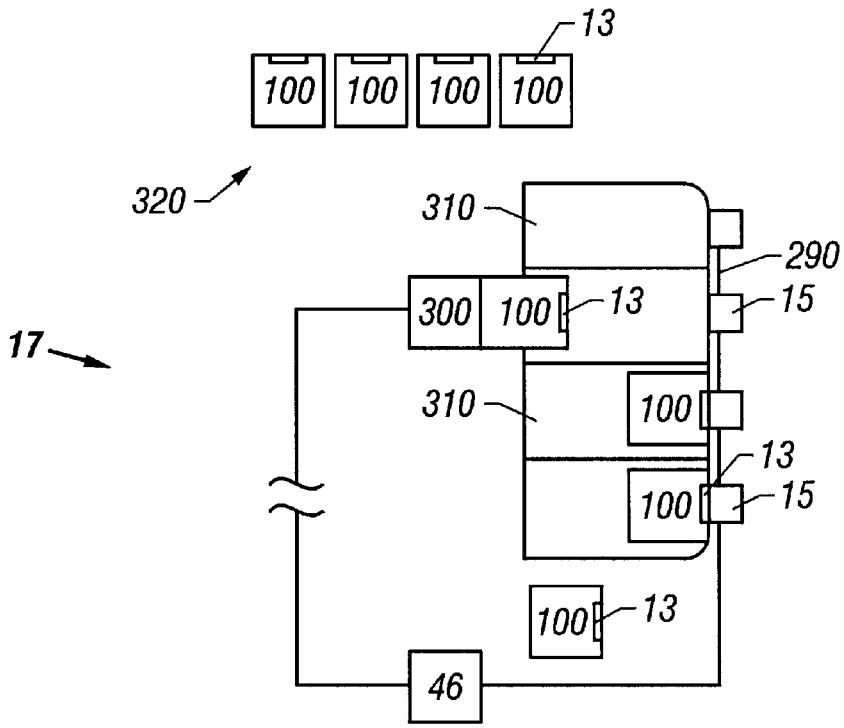
FIG. 12 is an illustrative block diagram of an automated storage media library utilizing the connector assemblies of the previous Figures.

In this way, when connectors 13, 15 are brought into close proximity with each other, their magnets 29, 59 align and join core 25 and insert 45 sufficiently to complete an electrical circuit therebetween, such that connectors 13, 15 (a) require zero-insertion force to be joined, (b) electrically interface and mechanically couple, and (c) are positively retained. Connector system 11 is also for use in a system where the carrier is positively retained either by a latching cam mechanism or a motorized insertion/extraction mechanism. In addition, the springs 57 inside cavities 51 will bias inserts 45 outward back into their extended positions (FIG. 3) when sufficient withdrawal force is applied to drive assembly 100 to overcome the attraction between magnets 29, 59 and extract drive assembly 100 from bin 310 (FIG. 12).

Figure 10:
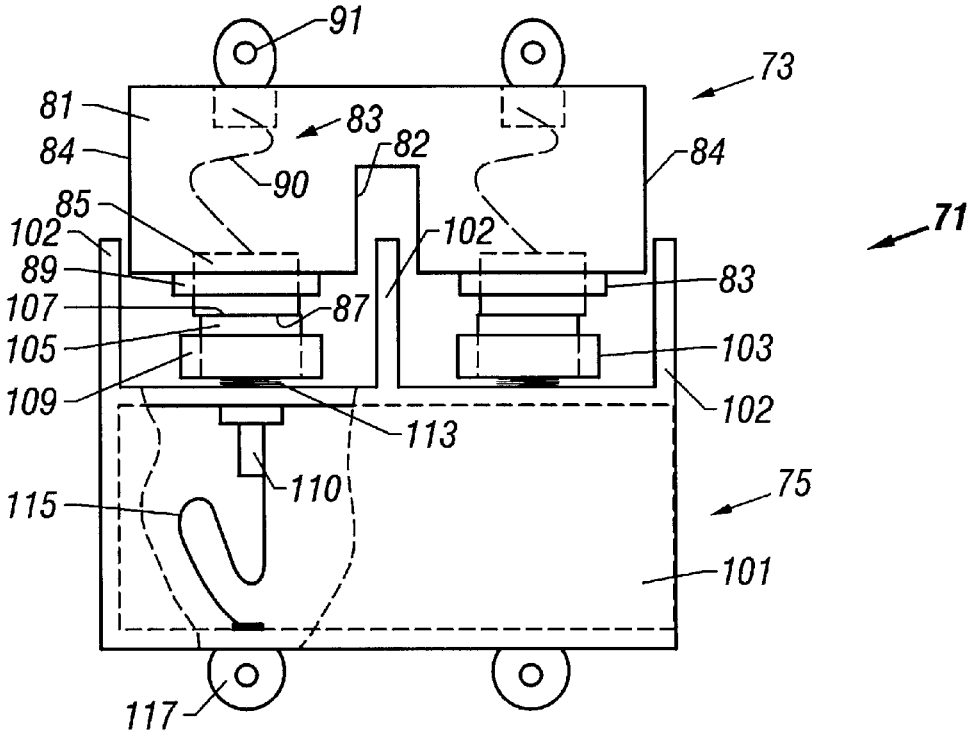
FIG. 10 is a half-sectional side view of the carrier and backplane connectors of FIGS. 7 and 8, respectively, in operation.

Referring now to FIG. 10, a second embodiment of a connector system 71 having two separable carrier and backplane connectors 73, 75, respectively, is shown. Connector system 71 may be implemented in a computer data access and storage system such as the data storage system of FIG. 12 (described above for connector system 11), as well as various other systems and devices.

Figure 6:
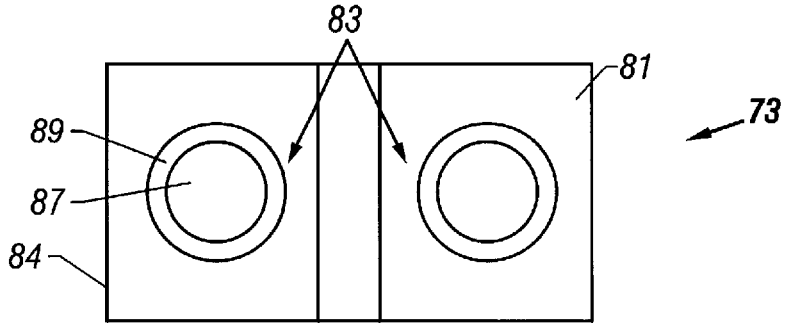
FIG. 6 is a plan view of another embodiment of a carrier connector constructed in accordance with the present invention.
Figure 7:
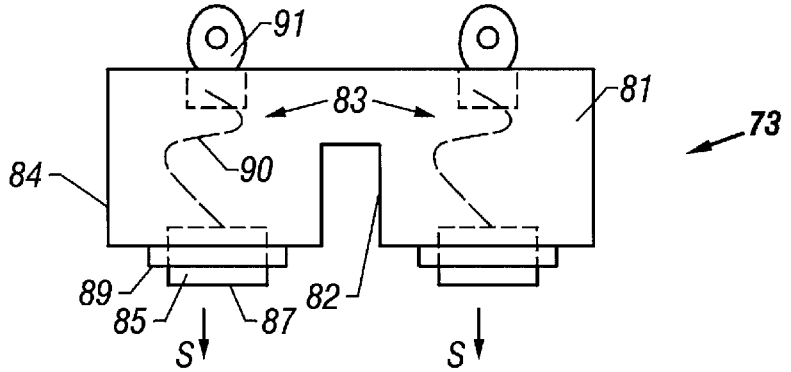
FIG. 7 is a side view of the carrier connector of FIG. 6.

As shown in FIGS. 6 and 7, connector system 71 has a carrier connector 73 with a generally rectangular body 81 and at least one interfacing element 83 (two shown) that are mounted therein in a side-by-side configuration. Body 81 is provided with a rectangular slot 82 between each adjacent pair of interfacing elements 83. The open side walls 84 of body 81 function in the same manner.

Each interfacing element 83 comprises a cylindrical contact 85 of electrically conductive material having a circular contact surface 87 that protrudes from a coupling device 89. In the preferred embodiment, contact 85 is a metallic burnished copper, silver, or other highly conductive material, and coupling device 89 is a permanent ring magnet that surrounds contact surface 87. Ideally, the outer face of coupling device 89 is coaxial with but axially offset from contact surface 87, as shown. Each interfacing element 83 also has an electrical connection 90 extending to an electrical connection 91, such as a solder connection, that is located opposite contact surface 87 for interconnecting with a host device.

Figure 8:
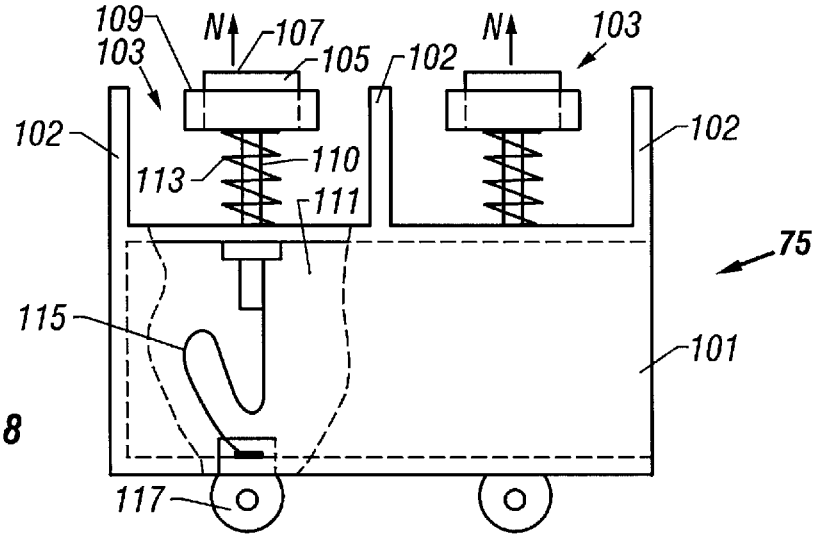
FIG. 8 is a half-sectional side view of another embodiment of a backplane connector constructed in accordance with the present invention and taken along the line 8—8 of FIG. 9.
Figure 9:
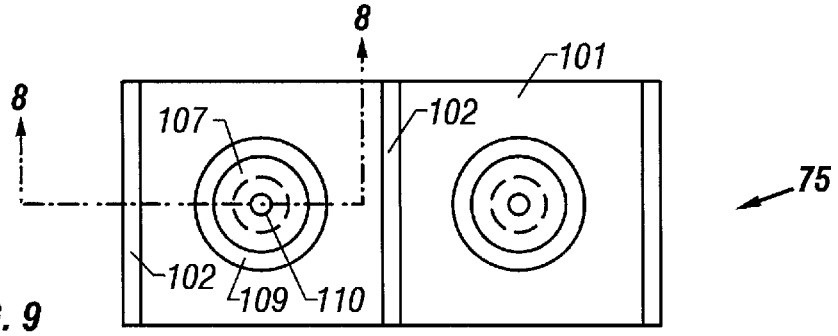
FIG. 9 is a plan view of the backplane connector of FIG. 8.

Referring now to FIGS. 8 and 9, the other or mating component of connector system 71 is backplane connector 75. Each backplane connector 75 has a generally rectangular body 101 and at least one interfacing element 103 (two shown) that are mounted to body 101, side-by-side. Body 101 also has a set of parallel alignment devices or walls 102 that protrude from one end. Ideally, the number of interfacing elements 103 corresponds to and coaxially aligns with the number of interfacing elements 83 in carrier connector 73 in a one-to-one ratio.

Each interfacing element 103 comprises a movable contact 105 of electrically conductive material having a contact surface 107. In the preferred embodiment, contact 105 is a generally cylindrical, metallic burnished copper, silver, or other highly conductive material that protrudes axially from a coupling device or ring magnet 109. Note that the outer surface of magnet 109 is substantially flush with the distal ends of walls 102, and that contact surface 107 is located beyond walls 102.

Each interfacing element 103 is mounted to a movable, narrow diameter plunger 110 that can be pushed into a cavity 111 in body 101. A compression spring 113 is located between body 101 and magnet 109 for biasing interfacing element 103 to the extended position shown in FIG. 8.

The end of plunger 110 opposite contact 105 is electrically connected to a flexible electrical conduit 115. Conduit 115 is also located in cavity 111 and extends between plunger 110 and an electrical connection 117 such as a solder connection. Conduit 115 is flexibly movable between the extended position of FIG. 8, wherein contact surface 107 extends beyond walls 102, and a retracted position (FIG. 10) wherein interfacing element 103 is depressed via plunger 110 and contact surface 107 is located within walls 102.

In operation (see, e.g., FIG. 12), connector system 71 operates in substantially the same manner as connector system 11, described above. Carrier connector 73 is mounted to, for example, a disk drive assembly 100, and backplane connector 75 is mounted to a backplane such as backplane 290 in disk drive library 17. Solder connections 91, 117 are used to interconnect with the disk drive and backplane, respectively. In this example, a movable robotic picking mechanism such as picker 300 is used to handle the disk drives relative to a plurality of library drawers, such as bins 310 which are interconnected with backplane 290 and host computer 46.

As a disk drive assembly is inserted into a bin, connectors 73, 75 interconnect as shown in FIG. 10 to provide electrical power and/or operational control and/or data signals between the host computer, backplane, and disk drive assemblies. Note that one wall 102 on body 101 enters slot 82 in body 81, and that two walls 102 surround outer side walls 84 on body 81. Walls 102 are much narrower than slot 82 and do not interfere with each other. Instead, walls 102 merely help separate magnets 89, 109 to keep them from cross-attracting unintended magnetic targets.

When carrier connector 73 on the drive assembly is mated with backplane connector 75 on the backplane, the opposite-poled magnets 89, 109 attract each other in such a manner as to coaxially align their respective contacts 85, 105. Magnets 89, 109 pull contacts 85, 105 into contact with each other and push interfacing elements 103 such that plungers 110 enter cavities 111. Magnets 89, 109 do not make contact since they are separated by contacts 85, 105 as shown in FIG. 10. Since the contact areas of contacts 85, 105 have significant overlap, their respective surfaces 87, 107 make contact even when slightly off-axis so that electrical connectivity is assured. The springs 110 will bias interfacing elements 103 outward back into their extended positions (FIG. 8) when sufficient withdrawal force is applied to the drive assembly to overcome the attraction between magnets 89, 109 and extract the drive assembly from the library bin (see FIG. 12).

Figure 11:
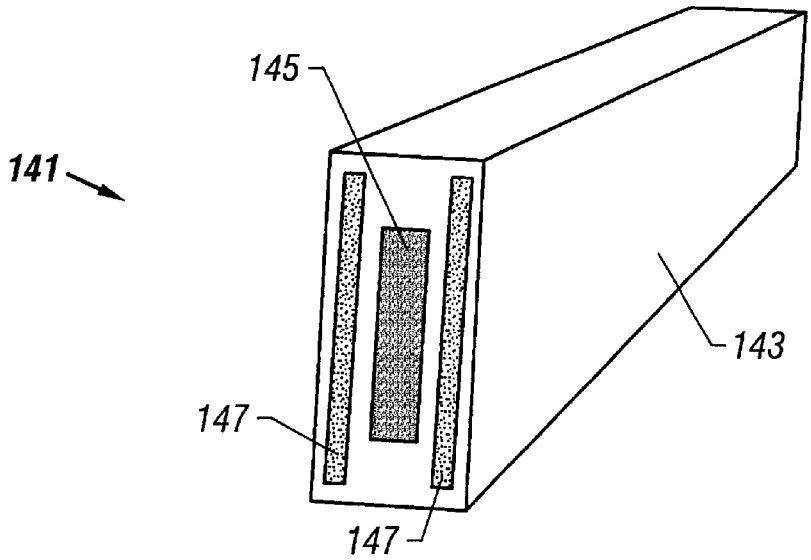
FIG. 11 is an isometric view of yet another embodiment of a carrier connector constructed in accordance with the present invention.

Referring now to FIG. 11, a schematic representation of a third embodiment of a connector system 141 is shown. In this version, a disk drive assembly 143 is provided with a zero-insertion force electrical connector 145, and one or more magnets 147 located adjacent to connector 145. Magnet 147 may comprise many different forms, but are designed to mate with metal strips located in the drawer of a library adjacent to its backplane (see, e.g., FIG. 12).

The present invention has many advantages over other prior art configurations. Disk drive assemblies or other removable devices that are equipped with the connector assemblies of the present invention require zero or minimal insertion force to engage and interface with a backplane or other component. This invention provides substantial positive retention of not only the connector itself to ensure a reliable connection is maintained after make-up, but also of the entire disk drive assembly in the library. This connection is augmented by a spring mechanism to further enhance the connection. Withdrawal of the removable device is readily accomplished by applying sufficient force to overcome the magnetic attraction.

While the invention has been shown or described in only some of its forms, it should be apparent to those skilled in the art that it is not so limited, but is susceptible to various changes without departing from the scope of the invention.

What is claimed is:

1. A disk drive library, comprising:

a host computer;

a backplane for interfacing with the host computer;

a plurality of backplane connectors interconnected with the backplane, each having at least one spring-biased first interfacing element that is independently movable between extended and retracted positions;

a plurality of disk drive assemblies;

a picker for handling the disk drive assemblies relative to the backplane;

an assembly connector mounted to each of the disk drive assemblies and having at least one second interfacing element for interconnecting with the first interfacing element;

alignment devices for facilitating alignment between the assembly and backplane connectors during make-up; wherein each of the assembly and backplane connectors comprises an electrically conductive component and a magnetic component that are coaxial with each other, respectively, the magnetic components circumscribing and being axially movable with their respective first interfacing elements; wherein power and control signals are provided between the backplane and the disk drive assembly when the disk drive assembly is coupled to the backplane; and wherein the assembly and backplane connectors (a) require zero-insertion force to join the disk drive assembly to the backplane, (b) electrically interface and mechanically couple the disk drive assembly with the backplane, and (c) provide positive retention of the disk drive assembly with the backplane.

* * * * *